United States Patent [19]

Arrington et al.

[11] 3,958,854

[45] May 25, 1976

[54] SPARK GAP APPARATUS

[75] Inventors: William Lee Arrington; Robert Dwight Gantt; Thomas Edward Gausman; Glen Edward Snyder, all of Batavia, N.Y.

[73] Assignee: GTE Sylvania Incorporated, Stamford, Conn.

[22] Filed: Oct. 2, 1974

[21] Appl. No.: 511,449

[52] U.S. Cl. ..... 339/111; 313/318; 313/325; 339/193 R

[51] Int. Cl.[2] ..... H01J 19/66; H01R 23/52

[58] Field of Search ..... 317/69, 99; 313/313, 313/318, 325; 339/14 T, 111, 143 R, 143 T, 192 T, 192 RL, 193, 194, 156

[56] References Cited

UNITED STATES PATENTS

| | | | |
|---|---|---|---|
| 2,259,740 | 10/1941 | Del Camp | 339/194 N |
| 2,274,354 | 2/1942 | Beggs | 339/143 T |
| 2,294,880 | 9/1942 | Alden | 339/143 T |
| 3,227,910 | 1/1966 | Pittman | 339/193 R |
| 3,553,727 | 1/1971 | Leimontas et al. | 313/325 |
| 3,728,587 | 4/1973 | Offerman | 339/193 R |

*Primary Examiner*—Roy Lake
*Assistant Examiner*—Neil Abrams
*Attorney, Agent, or Firm*—Norman J. O'Malley; Thomas H. Buffton; Robert T. Orner

[57] ABSTRACT

Spark gap apparatus is provided wherein a wafer of electrical conducting material is affixed to a wafer of electrical insulating material and spaced from a circular array of circular pins of an electron discharge device to provide a spark gap intermediate the wafer of electrical conducting material and certain ones of the circular pins of the electron discharge device.

2 Claims, 4 Drawing Figures

SPARK GAP APPARATUS

BACKGROUND OF THE INVENTION

Cathode ray tubes and particularly cathode ray tubes employed in color television receivers are subjected to high voltages which cause occasional arcing between the component parts within the tube. Also, the increasing use of cathode ray tubes with narrow neck portions with increased levels of applied potential results in arcing due to undesired dirt, burrs, and sharp edges. This arcing causes surges of excessive energy which is conducted by way of the tube pins and socket terminals to other components of the television receiver. Obviously, the components of an ordinary television receiver are not designed to withstand such excessive energy whereupon undesired and often catastrophic damage is incurred.

Numerous techniques have been employed in an effort to protect the components connected to the cathode ray tube from the application of undesired excessive energy due to arcing within the tube. For example, a number of prior art structures suggest arc gaps wherein spaced metal conductors are affixed to a layer of insulating material to provide an "arc" gap but not an "air" gap. Unfortunately, the arc energy carbonizes the insulating material which, in turn, becomes conductive and destroys the desired arc-gap.

In another known structure, a socket having metal inserts for receiving the circular pins of a cathode ray tube employs a metal conductor spaced from the metal inserts to provide an arc gap. Although such structures have been and still are employed with some degree of success, it has been found that they do leave something to be desired. More specifically, such structures require tolerances in fabricating the inserts and these tolerances undesirably affect the desired spark gap spacing. Moreover, most of the known structures are relatively expensive of materials and fabrication processing which is, of course, undesirable.

OBJECTS AND SUMMARY OF THE INVENTION

An object of the present invention is to provide enhanced spark gap apparatus suitable for use with an electron discharge device. Another object of the invention is to improve the arc gap apparatus of a television receiver. Still another object of the invention is to utilize the inherent dimensional tolerances of a cathode ray tube in the provision of arc gap apparatus. A further object of the invention is to provide improved spark gap apparatus contoured to conform to the configuration of an electron discharge device.

These and other objects, advantages and capabilities are achieved in one aspect of the invention by spark gap apparatus wherein wafers of electrical insulating and conducting materials are affixed to one another and include apertures in the insulating material aligned and formed to receive the circular pins in a circular array of an electron discharge device and provide a spark gap intermediate the wafer of electrical conducting material and certain ones of the circular pins.

PREFERRED EMBODIMENTS OF THE INVENTION

For a better understanding of the present invention, together with other and further objects, advantages and capabilities thereof, reference is made to the following disclosure in conjunction with the appended claims and accompanying drawings.

Figure 1:
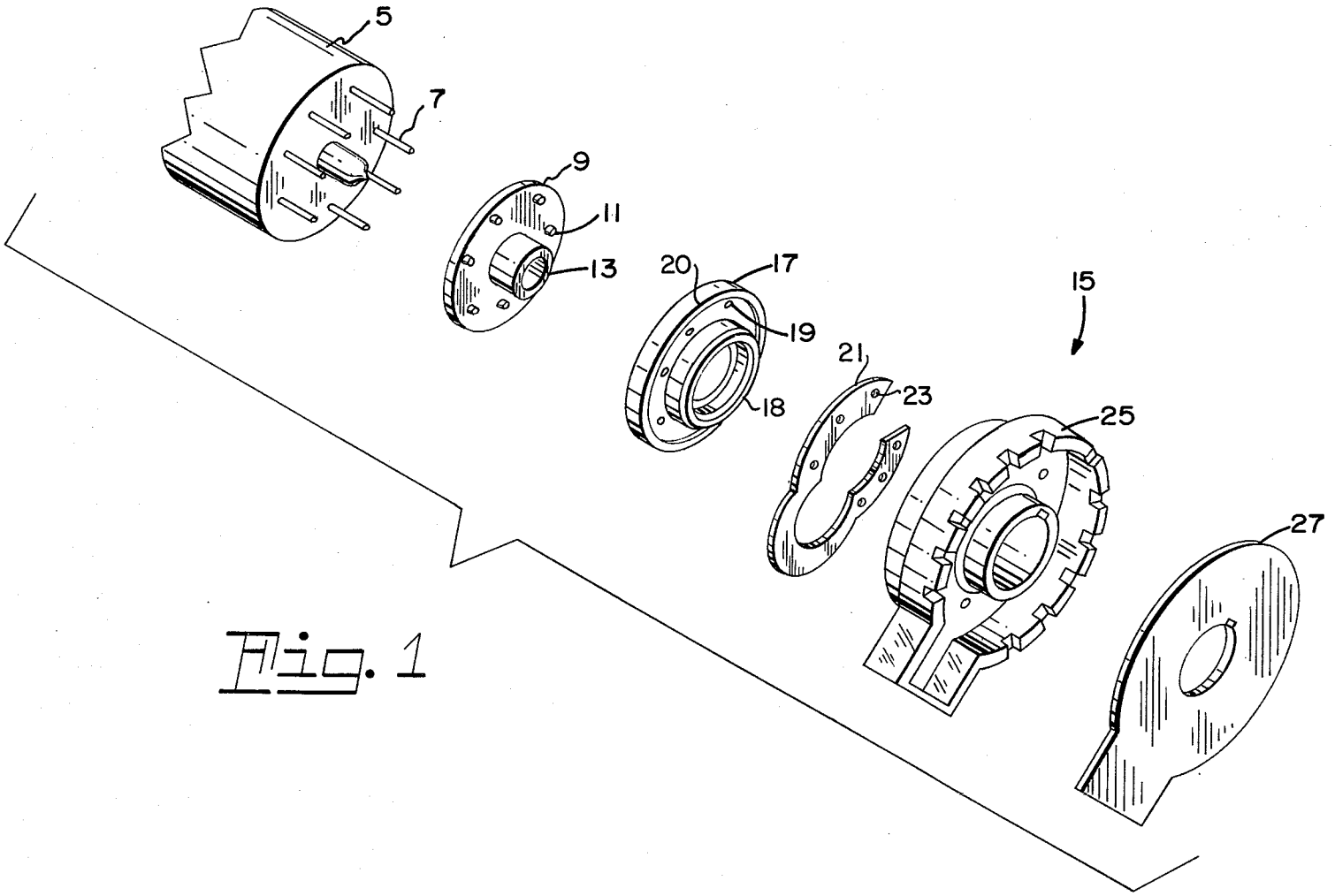
FIG. 1 is an expanded view of an electron discharge device, base and socket employing one embodiment of the invention.

Referring to the drawings, FIG. 1 illustrates an electron discharge device 5 having a plurality of circular pins 7 in a circular array and extending therefrom. A wafer of insulating material 9 includes a plurality of spaced apertures 22 formed to telescope over the circular pins 7. Moreover, the wafer of insulating material 9 has a central lug portion 13.

A socket member 15 includes a wafer of insulating material 17 having a raised ring-portion 18, circular apertures 19, and a ledge member 20 and a wafer of electrical conductor material 21 with circular apertures 23 and formed for attachment to the wafer of insulating material 17. A socket portion 25 includes an electrical connector (not shown) for electrically coupling each one of the circular pins 7. Moreover, a supporting cover member 27 is formed for attachment to the socket portion 25.

Figure 2:
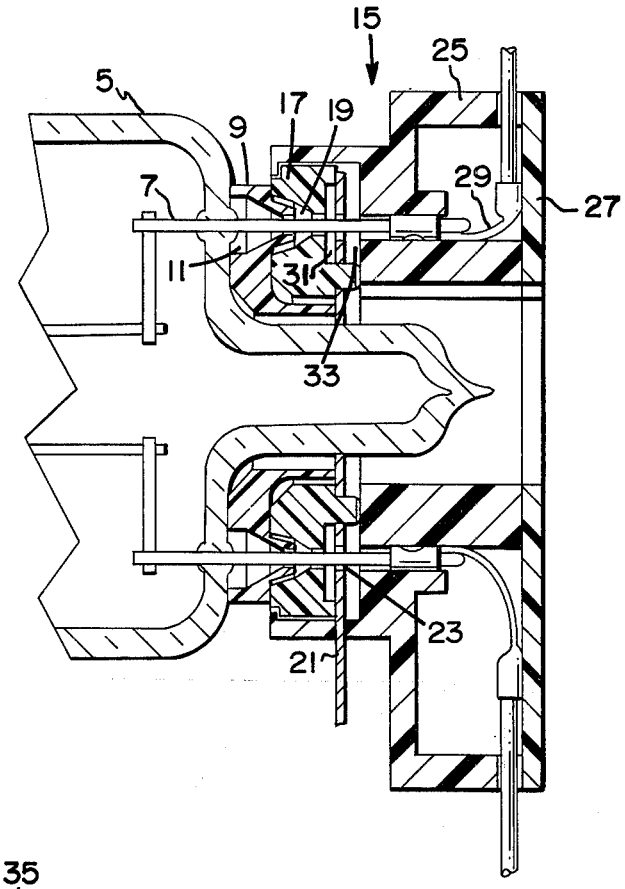
FIG. 2 is a cross-sectional view illustrating a preferred form of spark gap apparatus.

Employing the numbers of FIG. 1 in the cross-sectional view of FIG. 2, the electron discharge device 5 includes a plurality of circular pins 7 in a circular array extending therefrom and connected to electrical elements within the discharge device 5. A base wafer of electrical insulating material 9 is affixed to the electron discharge device 5 and includes a circular array of circular apertures 11 telescoped over the circular pins 7.

A socket member 15 includes a wafer of electrical insulating material 17 having a raised ring-portion 18, a circular array of tapered circular holes 19 which are formed for alignment with the circular pins 7 and a ledge member 20. A wafer of electrical conducting material 21 is affixed to the wafer of electrical insulating material 17 by heat staking or any one of a number of well-known attachment techniques. This wafer of electrical conducting material 21 also includes a plurality of circular apertures 23 in a circular array and aligned with the apertures of the wafer of electrical insulating material 17 and the circular array of circular pins 7. These circular apertures 23 of the wafer of electrical conducting material 21 are of a diameter greater than the diameter of the circular pins 7 and a spark gap, in this case an air gap, is provided intermediate the electrical conducting material 21 and the circular pins 7.

Further, a socket portion 25 of electrical insulating material has a cover member of electrical insulating material 27 affixed thereto by any one of a number of well-known techniques. An electrical connector 29, formed to telescope over and electrically connect the circular pins 7 to external electrical components (not shown), is disposed within the socket portion 25 and aligned with each one of the circular array of circular pins 7 of the electron discharge device 5.

Additionally, it should be noted that the wafer of electrical conducting material 21 is affixed to the wafer of electrical insulating material 17, in this example, in a manner such that air-gaps, 31 and 33 respectively, are provided intermediate the electrical conducting material 21 and the electrical insulating material 17 and socket portion 25. These air-gaps 31 and 33 are in addition to the air-gap or spark gap intermediate the electrical conducting material 21 and certain selected ones of the circular pins 7. Thus, carbonizing and electrical conductivity across the wafer of electrical insulating material 17 and the socket portion 25 is inhibited by the air-gaps 31 and 33.

Figure 3:
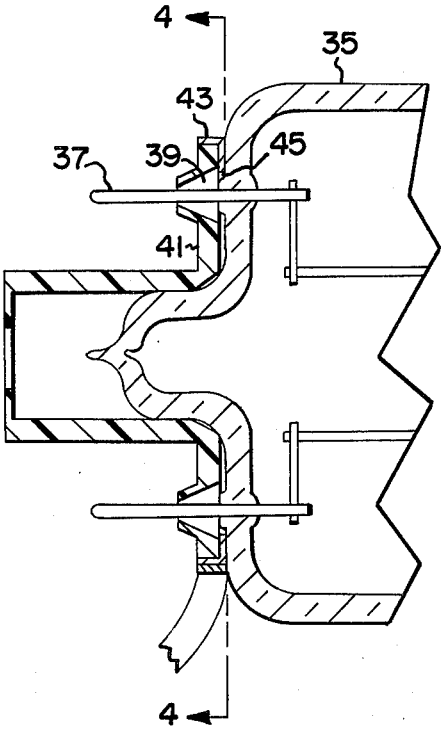
FIG. 3 is a cross-sectional view of an alternate embodiment of the spark gap apparatus of the invention.

Alternatively, FIG. 3 illustrates an electron discharge device 35 having a circular array of circular pins 37 connected to elements within and extending from the discharge device 35. Each of the circular pins 37 in the circular array extend through a tapered aperture 39 in a wafer of electrical insulating material 41.

Spaced from and affixed to the wafer of electrical insulating material 41 and immediate adjacent the electron discharge device 35 is a metal conductor 43. The metal conductor 43 is spaced from the circular array of circular pins 37 and provides an air-gap or spark-gap 45 intermediate the metal conductor 43 and the circular pins 37.

Figure 4:
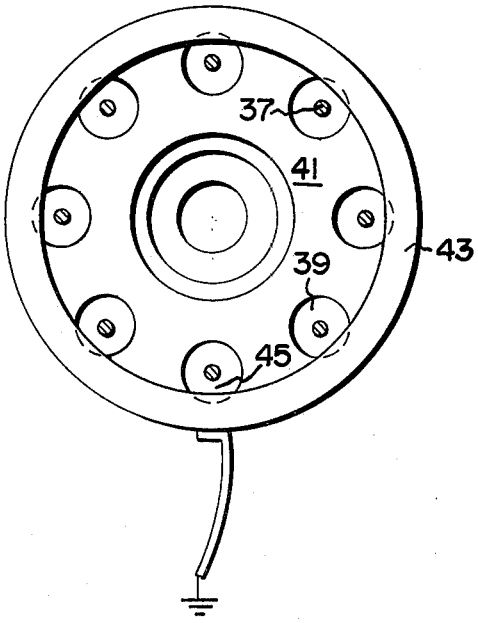
FIG. 4 is a plan view of the embodiment of FIG. 3.

As can more readily be seen in the plan view of FIG. 4, the circular array of circular pins 37 extend through the tapered apertures 39 of the wafer of electrical insulating material 41. The metal conductor 43 is affixed to the wafer of electrical insulating material 41 and disposed adjacent the circular array of circular pins 37 to provide an air-gap or spark-gap 45 intermediate the metal conductor 43 and each one of the circular pins 37.

Additionally, it should be noted that the wafer of electrical conductor material 21 of FIG. 2 is also suitable for use as a replacement for the metal conductor 43 of FIG. 3. Moreover, the metal conductor 43 of FIG. 3 may be disposed as a replacement for the electrical conductor material 21 of FIG. 2. In other words, apertures in the electrical conductor to provide a spark gap with a circular pin or an electrical conductor spaced from a circular array of pins to form a spark gap are appropriate to either the socket member 15 of FIG. 2 or the base member for the electron discharge device 35 of FIG. 3.

Also, it should be noted that the wafer of electrical conductor material 21 of FIG. 2 and the metal conductor 43 of FIG. 3 are preferably, not necessarily, connected to circuit ground. Thus, a desired spark gap or arc gap is provided intermediate either separate circular pins 37 and the metal conductor 43 or intermediate the circular array of circular pins 7 and the electrical conducting material 21.

Thus, there has been provided unique spark gap apparatus especially suitable for use with an electron discharge device, such as a cathode ray tube, having relatively high potentials applied thereto. The spark-gaps, or air-gaps in this instance, take advantage of the manufacturing tolerances and locations of the pins of the discharge device to enhance the dimensional control of the spark gap. Moreover, in the preferred embodiment the circular pins are extended through circular metal apertures whereby sharp edges and burrs are reduced to minimal amounts and the spark gap uniformity is enhanced.

While there has been shown and described what is at present considered the preferred embodiments of the invention, it will be obvious to those skilled in the art that various changes and modifications may be made therein without departing from the invention as defined by the appended claims.

What is claimed is:

1. A spark gap socket for an electron discharge device having a circular array of circular pins comprising:

a wafer of electrical insulating material having a plurality of circumferentially spaced circular apertures aligned with and formed to telescope over said circular array of circular pins of said electron discharge device;

a wafer of electrical conducting material having a plurality of circumferentially spaced circular apertures with each one of said circular apertures of said electrical conducting material aligned with and of a diameter greater than the diameter of corresponding ones of said apertures of said wafer of electrical insulating material, said wafer of electrical conducting material formed to provide an air gap intermediate said conducting material and each one of said circular pins of said electron discharge device and an air gap intermediate said conducting material and said wafer of insulating material in the region immediately adjacent the periphery of each of said circular apertures in said wafer of electrical conducting material; and a socket portion of electrical insulating material affixed to said wafers of electrical insulating and conducting materials and having a portion thereof spaced from said wafer of electrical conducting material to provide an air gap in the region immediately adjacent the periphery of each of said apertures in said electrical conducting material and intermediate said socket portion and said wafer of electrical conducting material, said socket portion including a hole in each of said portions spaced from said wafer of electrical material with each hole having an electrical conductor therein formed to receive a circular pin of said circular array of said electron discharge device.

2. The spark gap socket of claim 1 wherein said wafer of electrical insulating material, said wafer of electrical conducting material and said socket portion each include a central aperture formed to receive a base lug portion of an electron discharge device.

* * * * *